US005344344A

United States Patent [19]

Forsström

[11] Patent Number: 5,344,344

[45] Date of Patent: Sep. 6, 1994

[54] STEERING AND REVERSING SYSTEM FOR A MARINE JET PROPULSION UNIT

[75] Inventor: Jan-Olov Forsström, Kristinehamn, Sweden

[73] Assignee: Kamewa AB, Kristinehamn, Sweden

[21] Appl. No.: 852,232

[22] PCT Filed: Oct. 25, 1991

[86] PCT No.: PCT/SE91/00718

§ 371 Date: Jun. 5, 1992

§ 102(e) Date: Jun. 5, 1992

[87] PCT Pub. No.: WO92/07754

PCT Pub. Date: May 14, 1992

[30] Foreign Application Priority Data

Oct. 31, 1990 [SE] Sweden ..... 9003473-7

[51] Int. Cl.[5] ..... B63H 11/11

[52] U.S. Cl. ..... 440/41; 114/129; 440/43

[58] Field of Search ..... 440/38, 40, 41, 42, 440/43; 114/129

[56] References Cited

U.S. PATENT DOCUMENTS 3,478,712 11/1969 Fox ..... 440/43
3,827,390 8/1974 De Vault et al. ..... 440/43
4,509,923 4/1985 Turnbull .
4,895,093 1/1990 Dalsbo ..... 440/43

FOREIGN PATENT DOCUMENTS 726140 11/1966 Italy ..... 440/43

*Primary Examiner*—Michael S. Huppert
*Assistant Examiner*—Thomas J. Brahan
*Attorney, Agent, or Firm*—Browdy and Neimark

[57] ABSTRACT

A steering and reversing system for a marine jet propulsion unit having a stationary nozzle (3) for discharging a water jet rearwardly from the unit comprises a pair of steering and reversing members (4, 5) which are mounted side by side at the rear end of the nozzle and individually pivotable in opposite directions about upright axes (7) from a non-deflecting position to first and second deflecting positions. In the non-deflecting position, the steering and reversing members (4, 5) form a rearwardly directed extension of the nozzle, while in the first deflecting position each member diverts a portion of the water jet laterally outwardly by means of its front section (4*a*, 5*a*) and in the second deflecting position each member deflects a portion of the water jet downwardly and forwardly by means of scoop-like members at its rear section (4*b*, 5*b*).

8 Claims, 2 Drawing Sheets

STEERING AND REVERSING SYSTEM FOR A MARINE JET PROPULSION UNIT

BACKGROUND OF THE INVENTION

Technical Field of the Invention

This invention relates to a steering and reversing system for a marine jet propulsion unit for a water craft.

Basically, a jet propulsion unit for a water craft comprises a pump, usually an axial-flow pump, supported in the craft, typically in the stern thereof, the inlet of which is connected with a water intake in the bottom of the craft and the outlet of which is connected with a rearwardly directed discharge tube or nozzle, usually projecting rearwardly beyond the transom of the craft, for discharging the craft-propelling water jet.

For side steering of the craft, a mechanism is provided to deflect the water jet, or at least a part of it, laterally in either direction, and for slowing down the craft and/or making it go astern, a reversing mechanism is provided to deflect the water jet at least partially in the forward direction, usually downwardly and forwardly.

In the known water jet propulsion units, the side steering is usually accomplished by pivoting the nozzle, or the rear part of it, about a vertical axis by means of one or more actuators, commonly in the form of hydraulic cylinders. The reversal of the thrust of the water jet usually is accomplished by a separate reversing mechanism which is mounted in or behind the nozzle and comprises one or more flaps or scoop-like elements which are operable by means of one or more actuators, commonly hydraulic cylinders, to intercept the water jet and divert at least a portion of it in the desired direction, usually downwardly and forwardly.

Known side-steering and reversing systems thus comprise a large number of movable elements and actuators and therefore are complicated, space-consuming, heavy and expensive.

OBJECT AND SUMMARY OF THE INVENTION

An object of the present invention is to provide a steering and reversing system that is simpler, lighter, less space-consuming and cheaper than the known steering and reversing systems of the above-described kind.

To this end, according to the invention, there is provided a steering and reversing system for a jet propulsion unit for a water craft as set forth in the claims.

Generally stated, the steering and reversing system according to the invention comprises two elongate steering and reversing members which are mounted side by side on the nozzle and individually pivotable in opposite directions about upright axes from a neutral or non-deflecting position, in which they permit the water jet to pass rearwardly without being obstructed, to a first deflecting position, in which a front section intercepts a portion of the water jet and deflects it laterally outwardly from the nozzle, and a second deflecting position, in which a rear section including a scoop-like jet reversing element intercepts a portion of the water jet and deflects it downwardly and forwardly.

The invention is described in greater detail hereinafter with reference to the accompanying drawings, in which an embodiment of the steering and reversing system according to the invention is shown by way of example.

DETAILED DESCRIPTION OF THE PREFERRED EMBODIMENT(S) OF THE INVENTION

Figure 1:
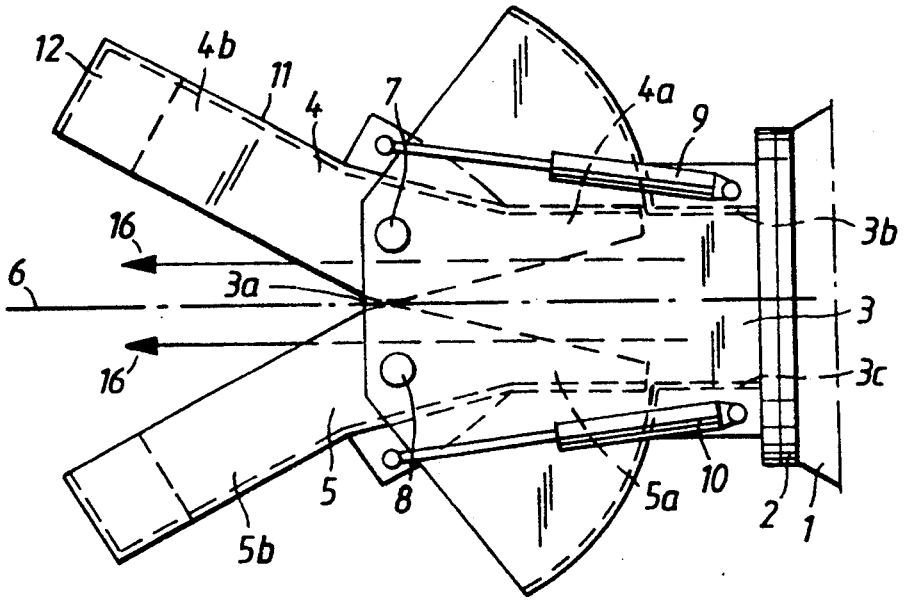
FIG. 1 is a top plan view of a steering and reversing system embodying the invention, the system being shown in a passive or neutral position for propelling the water craft straight ahead.

Referring to the drawings, only the rearmost portion of a water jet propulsion unit is shown, namely a pump housing 1 and a stationary outlet duct or nozzle 3 secured to a flange 2 of the pump housing and provided with the steering and reversing system according to the invention. Other parts of the jet propulsion units are omitted in the interest of clarity, as they can be constructed in any suitable manner, e.g. as illustrated and described in U.S. Pat. No. 4,474,561 or U.S. Pat. No. 4,538,997. Naturally, the connection of the nozzle 3 to the pump housing 1 may be different from that which is illustrated. For example, the nozzle may be integral with the pump housing.

The nozzle 3 is of generally rectangular, e.g. square, cross-section and comprises a horizontal top wall 3*a*, an essentially similar bottom wall (not shown), and two vertical side walls 3*b* and 3*c*. The two side walls 3*b*, 3*c* do not extend rearwardly as far as to the rear end of the nozzle 3, but have their rear edges at a considerable distance from that end. Accordingly, both sides of the rear portion of the nozzle 3 are open.

As shown in the drawings, the steering and reversing system comprises two elongate steering and reversing members 4 and 5 which are positioned symmetrically side by side at the rear end of the nozzle 3 on opposite sides of a vertical center plane 6 containing the axis of the nozzle. The two steering and reversing members are shaped such that each of them is a mirror image of the other in the center plane 6 and are mounted on vertical pivots 7 and 8 supported by the top and bottom walls of the nozzle 3. The steering and reversing members 4 and 5 are individually pivotally movable about the pivots 7 and 8 by means of respective actuators in the form of hydraulic double-acting cylinders 9 and 10; in the interest of simplicity and clarity, these actuators are shown only in FIG. 1.

Figure 5:
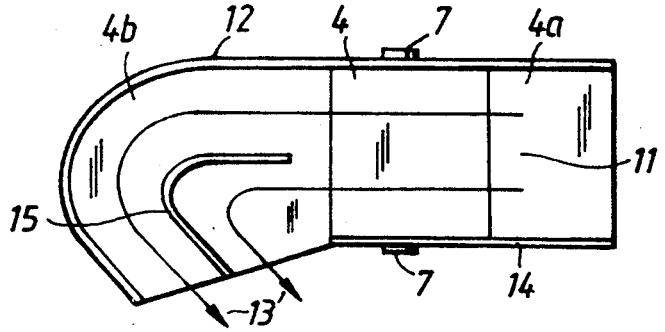
FIG. 5 is a side view of one of the steering and reversing members of the steering and reversing system shown in FIGS. 1 to 4.

Each of the two steering and reversing members 4, 5, of which the steering and reversing member 4 is also shown in side view in FIG. 5, comprises a front section 4*a*, 5*a* located forwardly of the associated pivot 7 and 8 beneath the top wall 3*a* of the nozzle 3 and a rear section 4*b*, 5*b* located rearwardly of the pivot 7 and 8.

A vertical side panel 11 on each member 4, 5 extends over both the front section and the rear section and forms an outer wall of each member.

A top panel 12 is secured (welded) to and extends inwardly from the horizontal upper edge of the side panel 11, likewise over both the front section 4*a*, 5*a* and the rear section 4*b*, 5*b*. The top panel 12 is horizontal and positioned immediately beneath the top wall 3*a* of the nozzle 3 at least in the region of the pivot 7.

As shown in FIGS. 1 to 4, the top panel 12 is tapered forwardly over the front section 4*a*, 5*a* while it is rectangular over the rear section 4*b*, 5*b*. At the transition between the front and rear sections, the inner edge of the top panel 12 is convexly curved about the pivot 7 and located in or very close to the vertical center plane 6.

As is also shown in FIGS. 1 to 4, each steering and reversing member 4, 5 is bent about the associated pivot 7 and 8 such that the rear sections 4*b*, 5*b* diverge rearwardly from the nozzle 3 when the steering and reversing members are in the neutral or non-deflecting position shown in FIG. 1, in which the front portion of the side panel 11 is aligned with the associated side wall 3*b*, 3*c* of the nozzle 3, i.e. parallel with the vertical center plane 6.

As is best shown in FIG. 5, the top wall 12 is extended downwardly and forwardly so as to form a scoop-like member. This scoop-like member serves to deflect a stream of water flowing rearwardly beneath the top wall such that the stream is caused to exit from the steering and reversing member 4, 5 downwardly and forwardly as indicated by arrows 13 in FIG. 5.

As is also apparent from FIG. 5, each steering and reversing member 4, 5 comprises a horizontal bottom panel 14 which is secured to and extends inwardly from the horizontal lower edge of the side panel 11. The bottom panel 14 extends over the front section 4*a*, 5*a* of the steering and reversing member and a portion of the rear section 4*b*, 5*b*. From FIG. 5 it is also seen that the top and bottom panels 12, 14 are provided with elements forming the pivot 7.

One or more guide vanes secured to the rear portion of the side panel 11 of each steering and reversing member 4, 5 assist in the deflection and reversing of the water jet in the scoop-like member. One such guide vane is shown at 15 in FIG. 5.

In the neutral or non-deflecting position shown in FIG. 1, the front portions of the side panels 11 form extensions of the side walls 3*b*, 3*c* of the nozzle 3 and cover the lateral openings of the nozzle which are defined by the top wall 3*a* and the bottom wall. In this position, the scoop-like jet reversing members of the rear sections 4*b*, 5*b* are positioned outside the area directly behind the jet discharge passage defined by the nozzle 3, that is, outside the area swept by the water jet discharged from the nozzle. In other words, the steering and reversing members 4, 5 do not influence the water jet which is thus directed straight rearwardly as indicated by arrows 16 in FIG. 1 to propel the water craft straight ahead.

Figure 2:
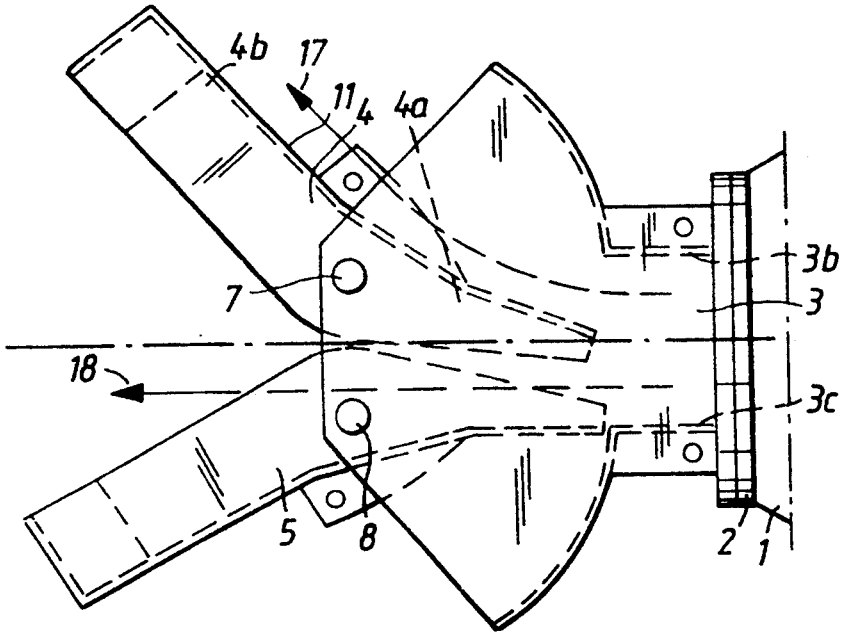
FIG. 2 is a similar top plan view showing the system in a position for propelling the water craft forwardly while turning.

If one of the steering and reversing members, e.g. the steering and reversing member 4, is swung such that its front section is moved inwardly into the discharge passage of the nozzle 3 as shown in FIG. 2, it assumes a first jet deflecting position to deflect a portion of the water jet laterally outwardly away from the nozzle 3 as is indicated by arrows 17 in FIG. 2. In this position, the outer side of the side panel 11 of the steering and reversing member 4 forms a smooth, curved deflecting surface. The remaining portion of the water jet is still directed straight rearwardly as indicated by an arrow 18 in FIG. 2.

Pivoting the steering and reversing member 4 in the opposite direction to a second deflecting position will cause its front section 4*a* to be moved laterally outwardly from the neutral or non-deflecting position shown in FIG. 1 while its rear section 4*b* is caused to be moved laterally inwardly to a position in which its scoop-like jet deflecting member is wholly or partly directly behind the discharge passage of the nozzle 3. Accordingly, a portion of the water jet will be intercepted by the scoop-like member and deflected downwardly and forwardly in the above-described manner.

Figure 3:
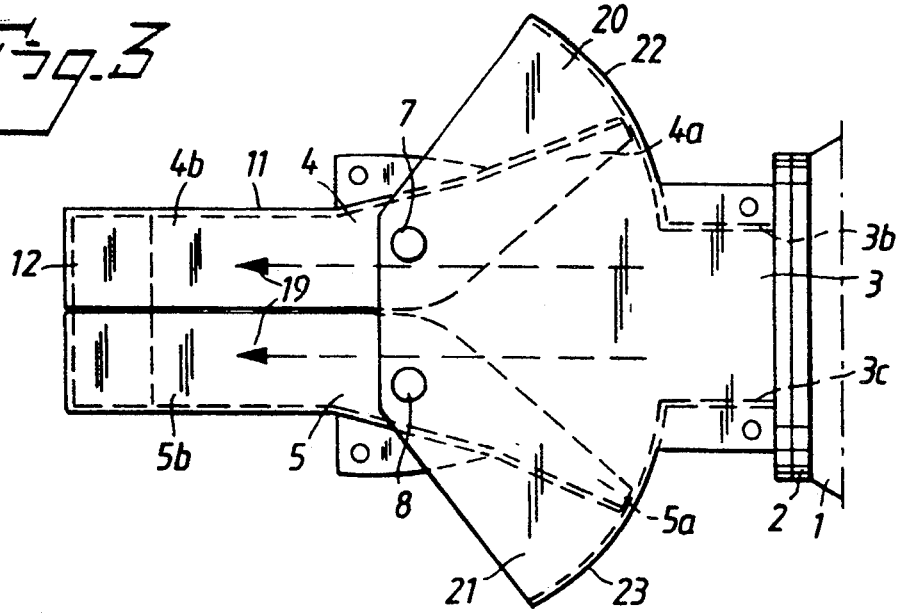
FIG. 3 is a similar top plan view showing the system in a position for full reversal for going straight astern.

FIG. 3 shows both steering and reversing members 4, 5 moved to the second deflecting or jet reversing position, namely with the rear sections 4*b*, 5*b* of both steering and reversing members positioned directly adjacent one another and aligned with the vertical center plane 6. In this position, the two steering and reversing members receive the full water jet and deflect it downwardly and straight forwardly to move the water craft straight rearwardly.

The water jet is prevented from escaping laterally from the discharge passage of the nozzle 3 by the front portions of the side panels 11, lateral extensions 20 and 21 of the top and bottom walls of the nozzle 3 and curved front walls 22 and 23 which close off the space between the top and bottom walls in the forward direction.

Figure 4:
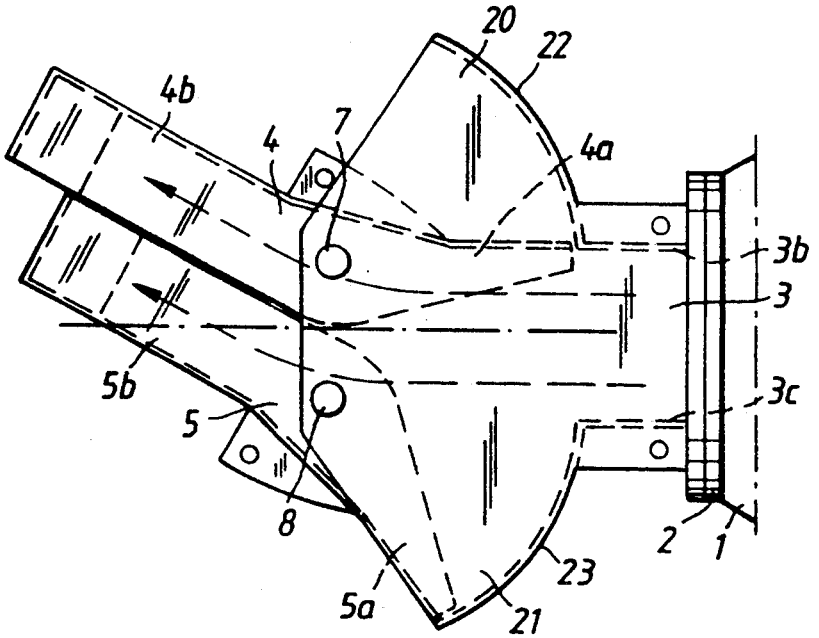
FIG. 4 is a similar top plan view showing the system in a position for causing the craft to go astern while turning.

FIG. 4 shows the steering and reversing member 4 in the same position as in FIG. 1 and the other steering and reversing member 5 pivoted to a position in which its rear section 5*b* is positioned directly adjacent and alongside the rear section 4*b* of the steering and reversing member 4. With the two steering and reversing members in these positions, the full water jet is first deflected laterally and then downwardly and forwardly at an angle to the vertical center plane 6 to propel the water craft astern while turning it.

Naturally, the steering and reversing members 4 and 5 can be pivoted to positions intermediate the position shown in FIG. 1 on the one hand and the side-steering and reversing positions shown in FIGS. 2 to 4, on the other hand.

Several modifications of the exemplary embodiment shown and described above can be made within the scope of the invention. For example, the side panels 11 of the steering and reversing members 4, 5 may have a concavely curved vertical cross-section or contour, at least on the outer side, so as partially to contain the laterally deflected water jet in the side-steering forward propulsion mode illustrated in FIG. 2.

Moreover, the rear sections 4*b*, 5*b* of the steering and reversing members 4, 5 may be shaped such that in the sidesteering reverse mode, the rear sections 4*b*, 5*b* of the steering and reversing members are partially nested, the degree of nesting being dependent on the desired sharpness of the turn.

The rear sections 4*b*, 5*b* of the steering and reversing members 4, 5 may also be modified to resemble Pelton wheel buckets and impart a smaller or larger degree of lateral deflection of the water jet in the reverse mode.

I claim:

1. A steering and reversing system for a marine jet propulsion unit having at a rear end thereof a stationary jet nozzle (3) which defines a rearwardly extending passage for discharging a water jet rearwardly from the unit, characterized in that the steering and reversing system comprises two elongate steering and reversing members (4, 5) which are positioned side by side and individually pivotable in opposite directions about upright axes (7, 8) from a non-deflecting position to either of a first deflecting position and a second deflecting position, each steering and reversing member (4, 5) comprises a generally upright side panel (11) and a top panel (12) which is generally perpendicular to the side panel and the rear portion of which merges with a downwardly and forwardly curved extension forming a jet reversing scoop, each steering and reversing member (4, 5) in the non-deflecting position thereof forms a rearwardly directed extension of the nozzle passage and has its jet reversing scoop laterally offset from the region directly behind the nozzle passage, each steering and reversing member (4, 5) in the first deflecting position thereof has the foremost portion of its side panel (11) positioned relative to the nozzle passage and extending rearwardly and laterally outwardly to deflect a portion of the jet from the nozzle passage laterally outwardly, and each steering and reversing member (4, 5) in the second deflecting position thereof has its jet reversing scoop at least partly positioned directly behind the nozzle passage to deflect a portion of the jet downwardly and forwardly.

2. A steering and reversing system as claimed in claim 1, characterized in that the steering and reversing members (4,5) are mounted for pivotal movement on vertical pivots (7) supported by the rear end of the nozzle (3) on opposite sides of a vertical center plane (6) of the nozzle, the steering and reversing members (4,5) being shaped such that each of them is a mirror image of the other in the vertical center plane (6) .

3. A steering and reversing system as claimed in claim 2, characterized in that each steering and reversing member (4,5) comprises a front section (4*a*,5*a*) and a rear section (4*b*,5*b*) located respectively forwardly and rearwardly of the pivot axis (7), in that the side panel (11) extends over both the front section and the rear section, and in that the top panel (12) extends laterally inwardly from the upper edge of the side panel (11).

4. A steering and reversing system as claimed in claim 3, characterized in that the front and rear sections (4*a*,5*a*; (4*b*,5*b*) when viewed in plan view include an obtuse angle and in that with both steering and reversing members (4,5) in the inactive position the rear sections (4*b*,15*b*) diverge rearwardly.

5. A steering and reversing system as claimed in claim 3 characterized in that the nozzle (3) is of a substantially rectangular cross-section and comprises a horizontal upper wall (3*a*) and vertical side walls (3*b*,3*c*) associated with respective ones of the steering and reversing members (4,5), in that each steering and reversing member (4,5) in the non-deflecting position thereof has the said foremost portion of its side panel (11) generally aligned with the associated nozzle side wall (3*a*,3*b*) and blocking a lateral opening provided in the nozzle (3), in that the top panel (12) is substantially parallel with and positioned close to the upper horizontal nozzle wall (3*a*) at least at a region close to the associated pivot axis (7).

6. A steering and reversing system as claimed in claim 4 characterized in that the two steering and reversing members (4,5) are pivotable to a position in which their rear sections (4*b*,5*b*) are substantially parallel with the facing edges of the top panels (12) positioned close to one another and in which the said foremost portions of the side walls (11) are aligned with or offset laterally outwardly from the respective associated nozzle side walls (3*b*,3*c*) so that the rear sections of the steering and reversing members (4,5) accommodate substantially all of the water jet and deflects it downwardly and forwardly.

7. A steering and reversing system as claimed in claim 6, characterized in that the nozzle (3) also includes a bottom wall and in that the top and bottom walls of the nozzle (3) include a pair of extensions (20,21) which extend laterally outwardly in opposite directions over the regions over which the front sections (4*a*,5*a*) of the steering and reversing members (4,5) are movable laterally outwardly from the nozzle sidewalls (3*b*,3*c*).

8. A steering and reversing system as claimed in claim 7, characterized in that a pair of front walls (22,23) extend laterally outwardly from respective ones of the nozzle side walls (3*a*,3*b*) at the front edges of the said lateral openings over the regions over which the front sections (4*a*,5*a*) of the steering and reversing members (4,5) are movable laterally outwardly from the nozzle sidewalls (3*b*,3*c*) so that the front walls (22,23) close the gap between the extensions (20,21) over the said region.

* * * * *